United States Patent [19]

Kato et al.

[11] Patent Number: 4,892,293

[45] Date of Patent: Jan. 9, 1990

[54] BRICK CASTING METHOD OF MAKING A STAVE COOLER

[75] Inventors: Yoichiro Kato; Hiroyuki Takao; Yasuhide Koga; Tsuguro Takashima, all of Kitakyushu, Japan

[73] Assignee: Nippon Steel Corporation, Tokyo, Japan

[21] Appl. No.: 323,784

[22] Filed: Mar. 15, 1989

[30] Foreign Application Priority Data

May 25, 1988 [JP] Japan ..... 63-125842

[51] Int. Cl.[4] ..... C21B 7/10

[52] U.S. Cl. ..... 266/193; 122/6 B

[58] Field of Search ..... 266/281, 280, 287, 44, 266/190, 193, 194; 122/6 A, 6 B

[56] References Cited

U.S. PATENT DOCUMENTS 4,162,061 7/1979 Bühler et al. ..... 122/6 B
4,335,870 6/1982 Diener et al. ..... 122/6 B
4,620,507 11/1986 Saito et al. ..... 266/193

FOREIGN PATENT DOCUMENTS 0041966 12/1979 Japan ..... 266/193
1118684 10/1984 U.S.S.R. ..... 266/193

*Primary Examiner*—S. Kastler
*Attorney, Agent, or Firm*—Wenderoth, Lind & Ponack

[57] ABSTRACT

A method of producing a hearth stave cooler including a cooling pipe cast therein for cooling furnace walls of a blast furnace or the like and having refractory bricks on the working side of the stave cooler, wherein one of the upper and lower surfaces of each refractory brick to be brought into contact with molten iron is covered with a heat-insulating buffer material, the other surface is covered with metal wool, and the back of each refractory brick is preferably covered with the heat-insulating buffer material or the metal wool and then the molten iron is cast.

5 Claims, 1 Drawing Sheet

BRICK CASTING METHOD OF MAKING A STAVE COOLER

BACKGROUND OF THE INVENTION

1. Field of the Invention

This invention relates to a brick casting method of stave coolers used for cooling the furnace walls of blast furnaces, or the like. The stave coolers are generally arranged between the outer shell and the inner refractory brick wall of a blast furnace, for example.

2. Description of the Related Art

Cracks often occur in bricks when the bricks are cast in the stave cooler in accordance with the prior art technique. To eliminate the problem of cracks it has been a common practice to bond a heat-insulating buffer material to both side surfaces of the bricks for casing the bricks in the stave coolers, as disclosed, for example, in Japanese Patent Publication Nos. 8241/1977 and 31811/1977.

The method described above has been employed on the basis of discovery that the cracks develop on both inner and outer surfaces of the bricks when they are cast in a naked state with molten iron of near 1,300° C. and their stability required as the brick for a hearth stave is thereby lost. The function of this heat-insulating buffer material is to mitigate the thermal impact caused on the bricks and to avoid the cracking of the bricks due to the shrinkage of the stave cooler itself. For this purposes a ceramic felt or the like has been conventionally used as the heat-insulating buffer material.

Further, it is known to apply asbestos on the lower side of the bricks embedded in stave coolers as disclosed in No. 3, March 1967.

Meanwhile it has been found by the present inventors that the above-mentioned prior arts have the following problems.

In the initial casting step where the bricks are arranged in a casting mold and molten pig iron cast around the bricks, every surface of the bricks arranged in the mold is exposed instantaneously to high temperatures around 1,200° C. and severe thermal impact, causing inevitably cracks in the bricks.

According to the above-mentioned prior arts, the heat-insulating buffer material is applied on both upper and lower surfaces of the bricks so that the thermal impact on both surfaces may be mitigated, but the thermal impact on the back side surface cannot be prevented and causes cracking of the brick therefrom.

If stave coolers embedded with bricks suffering the internal cracks caused as above are used in furnace walls of a blast furnace, the internal cracks propagate and expand due to thermal expansion of the bricks caused by the furnace heat after the consumption of the innermost furnace wall bricks, and in combination of severe friction action on the bricks caused by the furnace charges falling down along the furnace walls, the bricks will be wore off only in several years of service, thus lowering the heat insulating ability of the embedded bricks, hence promoting the wearing and consumption of the stave coolers, resulting in a shortened service life of the stave coolers.

Generally, the state coolers are fitted to the hearth walls and used in such a manner that the embedded refractory bricks are arranged in horizontal rows around the inside of the hearth wall. In accordance with the prior arts (Japanese Patent Publication Nos. 8241/1977 and 31811/1977) described above, therefore, the heat-insulating buffer material is placed on the upper and lower surfaces of the refractory bricks.

The heat-insulating buffer material must maintain its shrinkability even after the casting so that it can offset the thermal expansion of the refractory bricks caused when they are exposed to the heat of the furnace gas.

When the heat-insulating buffer material is used in the manner as described above in the wall of the blast furnace, the following problems are encountered.

Namely, the combination of the weight of the refractory bricks and the load acting downward in a vertical direction on the bricks by charge materials such as iron ore and coke filling the furnace and descending thereinalong with the formation of a hot metal compress and shrink the shrinkable heat-insulating buffer material which is positioned between the lower surface of the bricks and the cast iron of the stave. This moves downward the bricks minutely and a gap develops along the boundaries between the bricks and the cast iron on the upper surface of the bricks. Though the heat-insulating buffer material is also disposed on the upper surface of the bricks and though the buffer material maintains its shrinkability, it cannot expand enough to make up the gap developping on the upper surface of the bricks.

If the furnace is operated with the stave coolers having the gap left on the upper surface of the bricks, the high temperature furnace gas enters this gap. Therefore, the refractory bricks are heated from their two surfaces, that is, from the working surface facing the inside of the furnace and from the upper surface. When the bricks are heated on the two surfaces, corrosion of the bricks on those surfaces proceeds rapidly. Accordingly, the bricks are at first corroded at the corners of the upper surface and the working surface and wear away into a triangular shape and finally, when the apex of the triangle reaches the back of the bricks, fall-off of the bricks occurs inevitably.

As described above, the method of casting the bricks with both of their side surfaces covered with the heat-insulating buffer material involves the problem of durability of the bricks.

On the other hand, regarding the back surface of the refractory bricks, if no cover of buffer material is applied to the back surface of the refractory bricks according to the prior arts, this side receives thermal impact which is substantially same as the thermal impact given to the naked brick when they are cast with the molten iron of near 1,300° C. Accordingly, it has been often difficult to prevent the cracking of the refractory bricks at the time of casting.

In other words, the cracks of the bricks occur frequently on the back side at the time of casting and they reduce drastically the ability and function of the stave cooler to retain the embedded bricks therein.

In this aspect, too, the prior arts are not free from the problem of low durability of bricks.

SUMMARY OF THE INVENTION

The present invention is completed in order to eliminate the problems confronted by the prior art techniques described above. In the brick casting method of a stave cooler having a cooling pipe cast therein for cooling hearth walls of a blast furnace or the like and having refractory bricks embedded and exposed on the working surface of the stave cooler, the present invention provides improvements characterized in that one of the upper and lower surfaces of each refractory brick to be brought into contact with the molten iron is covered with metal wool, the other surface is covered with a heat-insulating buffer material, and preferably the back of each refractory brick is covered with the heat-insulating buffer material or with the metal wool and then casting is performed.

As a result of intensive studies and experiments on various methods of casting refractory bricks in a stave cooler, the inventors of the present invention have found that the following different actions are exerted on the boundary between the bricks and the casting depending on the type of buffer material used.

(1) If the brick is not covered with any buffer material and the naked brick as such is brought into contact with molten iron, cracks develop on the inner and outer surfaces as described already. The cracks result from the following three kinds of causes. First of all, the cracks occur due to the thermal impact applied to the bricks at the time of casting. Secondly, the cracks occur because the bricks and the molten iron are solidified and bound to each other so that slide is inhibited on their boundary. In the third place, they occur because a soft and expansion absorber does not exist on the boundary.

The cracks of bricks due to the thermal impact occur because a large temperature gradient develops inside the brick which causes an internal stress leading to the cracks.

Adhesion between the brick and the molten iron solidifying thereon is an inevitable result due to the presence of fine pores and corrugations on the surface of the brick. Since the molten iron is cooled and solidified while it remains in these pores and corrugations, the brick and the casting are fixed to each other and the slide on the boundary is not permitted.

When the naked brick is embedded with the molten iron, the boundary surface between them after cooling gets into a solid adhesion state and there is formed no gaps thereinbetween. Accordingly, it cannot play the role of absorbing the expansion.

(2) If the brick is covered with a heat-insulating buffer material and thereafter cast, the molten iron is shut off by the heat-insulating buffer material (ceramic felt) and cannot reach the brick surface. The low thermal conductivity of the ceramic felt ($\lambda<0.05$ kcal/mh°C.) reduces drastically the thermal impact on the brick at the time of casting and the occurrence of cracks of the brick is prevented.

The ceramic felt remains between the brick and the casting even after casting, and the remainder keeps shrinkability of about 50% of the remaining thickness. The remainder of the ceramic felt maintains a large heat-insulating property ($\lambda<0.05$ kcal/mh°C.).

(3) The brick is covered with the metal wool and then cast. The metal wool used hereby is produced by cutting steel wires having a blank diameter of about 15 to 45 μm out of a steel material and is press-molded in a felt form with a density of about 400 to 700 kg/m$^3$ and a thickness of about 8 mm.

When the molten iron is poured after the brick is covered with the metal wool, the molten iron enters the voids among the blank wires of the metal wool but is deprived of its heat by the metal wool during its intrusion though the voids and is thus solidified. The film formed by initial solidification at this stage serves as a heat-insulating buffer material to the subsequently poured molten iron so that the thermal impact to the brick is mitigated and no crack occurs in the brick.

When the final stave is obtained after casting and cooling, the metal wool has been fused completely with the molten iron and has substantially the same texture as the original texture of the cast iron, but fusion adhesion between the brick and the cast iron does not occur due to the effect of the initial solidification film.

The boundary between the brick and the cast iron which is formed when the brick covered with the metal wool is in the solid contact state and has no gaps between them. Accordingly, though it cannot play the role of expansion absorption, it permits the slide therebetween because the brick and the cast iron are not fused to each other. Incidentally, the slide on the boundary is essential at the time of expansion absorption, and the heat conductivity of the boundary is higher than that of the ceramic felt. Further the metal wool can provide a favorable cushioning effect because it gets into a soft semi-fusion state.

Among the three kinds of actions by the different buffer materials described above, the present invention combines the advantages of the actions by the buffer materials in the items (2) and (3) hereinabove in order to meet with requirements for the stave cooler and to solve the problems of the prior arts.

Further it has been found that when both upper and lower surfaces of the bricks are covered with the heat-insulating buffer material alone, or with the metal wool alone, the problems mentioned herein before cannot be solved.

Namely, in the present invention, the lower surface side of each brick is covered with the metal wool and the brick is then cast in with the molten iron. In this way there is provided no shrinkability on the lower surface side, thus prohibiting the brick from moving downward due to the downward load, so that no gap is formed on the upper surface side. Since the upper surface side of each brick is covered with the ceramic felt and the brick is then cast in with the molten iron, it is possible to secure a necessary expansion allowance on the upper surface side.

When the back side of the brick is also covered with the ceramic felt, the heat-insulating property of the remaining felt reduces the heat applied from backside to the stave cooler.

In the present invention, it is essential that one of the upper and lower surfaces of the individual bricks is covered with the metal wool and the other surface is covered with the heat-insulating buffer material, and this combination assures the desired technical improvements and advantages. For example, when both the upper and lower surfaces are covered with the metal wool, and the staves having the bricks embedded in this way are used in the blast furnace, it is no more possible to obtain cushioning effect large enough to absorb the compression force exerted on the bricks by the thermal expansion of the cast iron, hence causing cracks in the bricks.

Further with the combination use of the covering materials according to the present invention, it is possible to give preheating to the bricks, to maintain an adequate cushioning effect, and to prevent the intrusion of molten iron into the bricks.

If the back side of the brick is covered with the metal wool, the heat applied to the stave cooler increases but the cooling effect of the cast brick can be improved accordingly.

In other words, the buffer material for the back of the brick can be selected freely in accordance with the materials of the brick and the functions required for the stave cooler.

The above and other objects and novel features of the present invention will become more apparent from the following description of preferred embodiments with reference to the accompanying drawings.

DESCRIPTION OF THE PREFERRED EMBODIMENTS

Hereinafter, preferred embodiments of the present invention will be described in detail with reference to the accompanying drawings.

Figure 1:
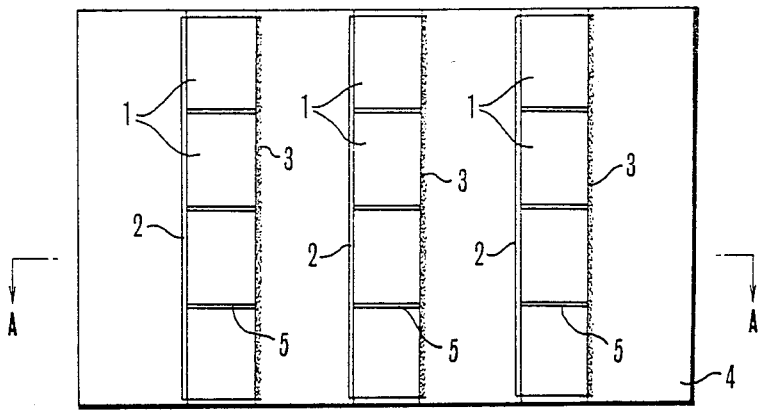
FIG. 1 is a front view of a stave cooler produced in accordance with the present invention.
Figure 2:
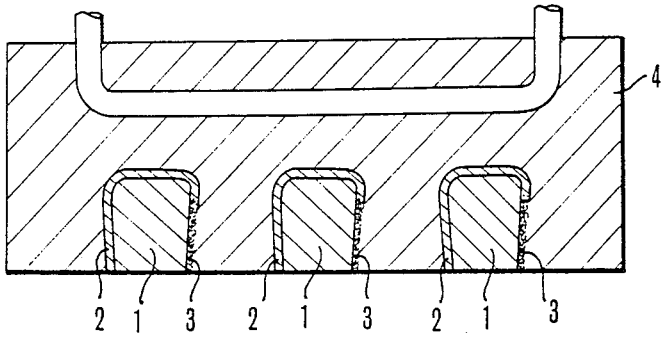
FIG. 2 is a sectional view taken along line A—A of FIG. 1.
Figure 3:
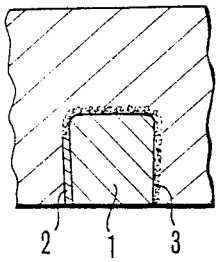
FIG. 3 is a sectional view showing another embodiment of the present invention.

FIGS. 1 and 2 show the first embodiment of the present invention. A plurality of (four, in this embodiment) traperzoidal refractory bricks 1 having a smaller dimension on the working side of a stave cooler (the surface which does not come into contact with the cast iron of the stave cooler) are arranged in a row and a plurality of such rows (three rows in this embodiment) are arrangedin parallel. Heat-insulating buffer material 2 is bonded to one of the upper and lower surfaces (the upper surface in this embodiment) and the back of each refractory brick 1 while metal wool 3 is bonded to the other surface (the lower surface in this embodiment). Pouring of molten iron is carried our under the state described above. The retained heat of the molten iron thus poured is transferred gently through the heat-insulating buffer material 2 and through the metal wool 3 to the refractory bricks 1 and is cooled. Therefore, no cracks due to the thermal impact occur on the bricks. In the casting 4 thus produced, the boundary surface between the metal wool 3 and the poured molten metal is not distinct because the metal wool 3 is molten and the cast iron 4 and the brick 1 are brought into solid contact state.

The metal wool 3 is integaated with the portion of the cast iron 4 of the stave cooler as finally obtained and since no foreign matter exists between the cast iron 4 and the refractory brick 1, there occurs no such problem that, when the stave cooler is used, the bricks move downward in the vertical direction with respect to the contact surface and that the gap is formed on the boundary of the upper surface of the bricks.

Since the bricks can slide in parallel with the contact surface, their expansion displacement is not impeded.

Furthermore, as one of the side surfaces of the refractory brick and its back are covered with the heat-insulating buffer material 2 and are thereafter cast, the buffer material maintaining its shrinkability remains between the brick and the casting of the product and can play the role of an absorber of thermal expansion when the stave cooler is used.

The heat-insulating buffer material must be excellent in burning-resistance as well as in intrusion resistance to the molten iron and must maintain shrinkability for at least 50% of the remaining thickness after casting. Commercially available heat-insulating materials include "Kao-Wool Paper LS" (tradename) for 1,300° C. application, and "Fiber Flux Paper" (tradename). They are ceramic felts of from 1 mm to 6 mm thick.

The metal wool may be the one that is described above.

The ceramic felt and the metal wool are felt-like and have high flexibility and excellent cutting and handling characteristics. Since the ceramic felt and the metal wool are bonded to the brick surface by an adhesive paste consisting of water glass, a refractory aggregate and the like, no peeling occurs at the time of casting. In the drawing, reference numeral 5 represents asbestos disposed between the refractory bricks 1.

With the structural features of the present invention as described above, the heat input at the initial stage of pouring of molten iron can be transmitted to the refractory bricks at a certain constant speed and pre-heats them. Therefore, thermal impact to the bricks at the initial stage of pouring can be mitigated and a stave cooler completely free from the brick cracks can be produced.

The heat-insulating buffer material, the metal wool and the refractory brick keep surface contact with one another but are not fixed. Accordingly, the thermal expansion behavior seen when the stave cooler is used can be absorbed readily by the slide on the contact surface and by flexibility of the heat-insulating buffer material and neither cracks nor peel of the bricks occur during the service.

Since the metal wool is used on the lower surface of the brick, the problem of the lowered durability of bricks resulting from the occurrence of gaps on the boundary with the upper surface due to the compression of the buffer material used on the lower surface side does not occur.

The ceramic felt and the metal wool are used relatively as the buffer materials for the back of the bricks so that a stave cooler having high heat-insulating property and a stave cooler having high cooling property can be produced selectively.

Whereas the two surfaces of bricks are covered with buffer material in accordance with the prior art method, it is preferred that the three surfaces of the bricks are covered in accordance with the brick casting method of the present invention. In this case, the cost of the buffer materials and their bonding work increase to about 1.5 times but the improvement in the function of the stave cooler is so great as to offset sufficiently such increases. Thus, durability of the stave cooler can be increased by several years.

Although the present invention has thus been described in connection with one preferred embodiment thereof, it will be obvious to those skilled in the art that the invention is not particularly limited thereto but can be changed or modified in various manners without departing from the spirit and scope thereof.

What is claimed is:

1. A method for producing a stave cooler having a cooling pipe for cooling a furnace wall and bricks embedded in a cast-iron stave body, said bricks being arranged in a horizontal row on a working side of stave cooler exposed to the furnace atmosphere, comprising covering said bricks on one of their upper and lower surfaces to be brought into contact with molten iron with metal wool and on the other surface with a heat-insulating buffer material and then pouring the molten iron around the brick row.

2. A method according to claim 1, wherein said bricks are covered on their lower surface with said metal wool and on their upper surface with said heat-insulating buffer material.

3. A method according to claim 1, wherein said bricks are covered on their back surface with said metal wool.

4. A method according to claim 1, wherein said bricks are covered on their back surface with said heat-insulating buffer material.

5. A method according to claim 1, wherein said metal wool is in the form of felt of steel wire of about 15 to 45 μm diameter and having a density of about 400 to 700 $kg/m^3$.

* * * * *